US005146850A

United States Patent [19]

Funada et al.

[11] Patent Number: 5,146,850

[45] Date of Patent: Sep. 15, 1992

[54] METHOD FOR CONTROLLING IMPRESSION-ON OPERATIONS FOR AN INTAGLIO PRINTING PRESS AND A DEVICE THEREOF

[75] Inventors: Hitoshi Funada, Chiba; Hiromitsu Numauchi, Toride, both of Japan

[73] Assignee: Komori Corporation, Tokyo, Japan

[21] Appl. No.: 699,900

[22] Filed: May 14, 1991

[30] Foreign Application Priority Data

Jun. 1, 1990 [JP] Japan ..... 2-141589

[51] Int. Cl.[5] ..... B41F 9/06; B41F 13/24

[52] U.S. Cl. ..... 101/153; 101/485

[58] Field of Search ..... 101/152, 153, 232, 235, 101/233, 242, 142, 143, 144, 145, 484, 485; 271/258, 259, 260, 262, 263, 265

[56] References Cited

U.S. PATENT DOCUMENTS 3,102,470 9/1963 Cragg et al. ..... 101/233 X

*Primary Examiner*—J. Reed Fisher

*Attorney, Agent, or Firm*—Abelman Frayne & Schwab

[57] ABSTRACT

In an intaglio printing press, a sheet printed by an impression cylinder impressed on a plate cylinder, ink rollers for transferring ink impressed on said plate cylinder and the sheet transmitted with held by the impression cylinder and the plate cylinder after the sheet fed from a feeder transmitted from an upstream of a feeder board to a downstream of the feeder board, the ink rollers are impressed on when the first sheet from starting sheet supply is positioned at the upstream of the feeder board and the impression cylinder is impressed on when the first sheet is arrived at the down stream of the feeder board so that an impression-on timing is hastened so as to transfer an ink on the plate cylinder to the first sheet when the first sheet is arrived between the impression cylinder and the plate cylinder, and the sheet supplying is stopped and the ink rollers and the impression cylinder are thrown off impression when an irregular register occurs in a printing operation.

2 Claims, 5 Drawing Sheets

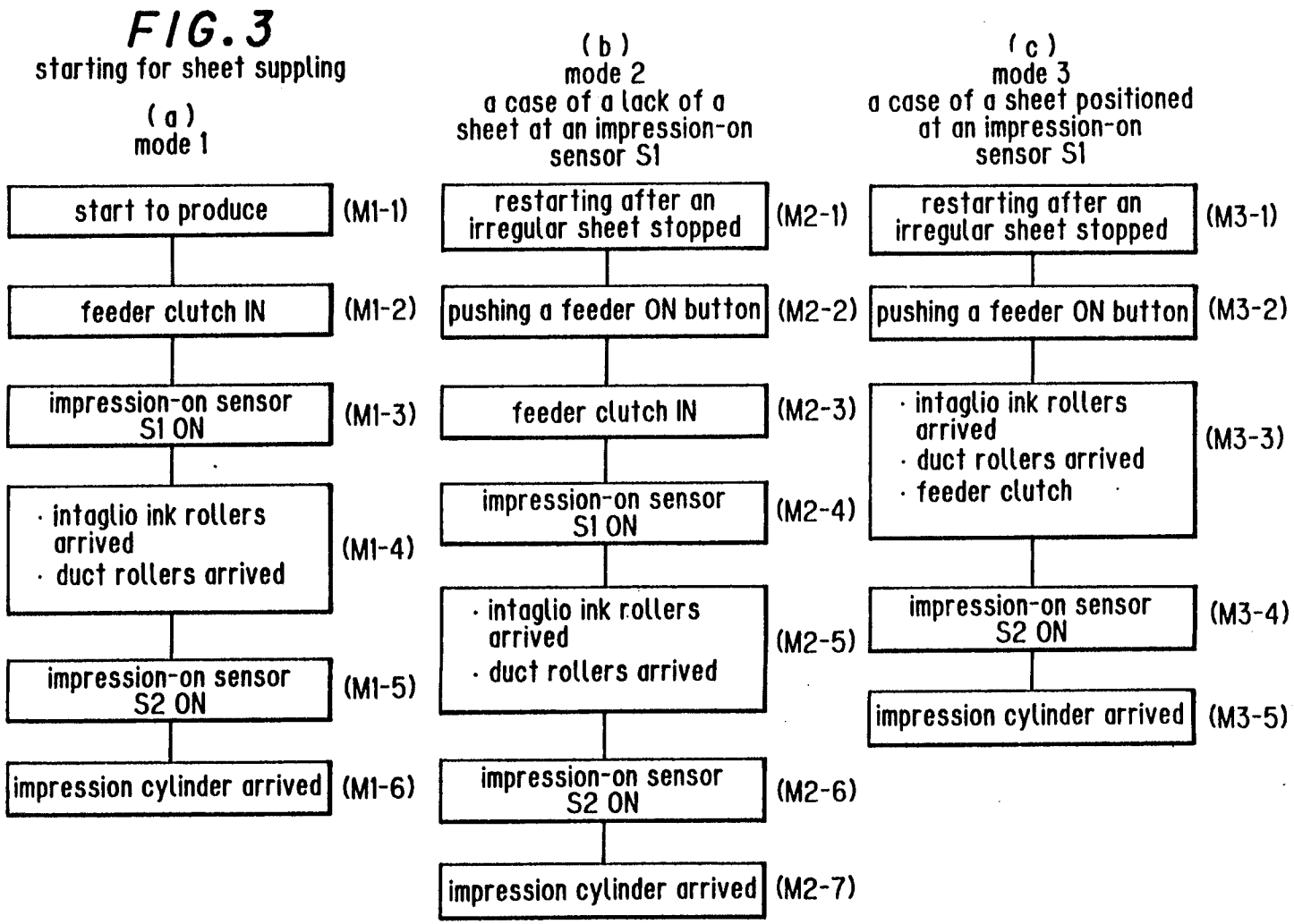
FIG. 3
starting for sheet suppling
(a)
mode 1
start to produce
(M1-1)
feeder clutch IN
(M1-2)
impression-on sensor S1 ON
(M1-3)
· intaglio ink rollers arrived
· duct rollers arrived
(M1-4)
impression-on sensor S2 ON
(M1-5)
impression cylinder arrived
(M1-6)
(b)
mode 2
a case of a lack of a sheet at an impression-on sensor S1
restarting after an irregular sheet stopped
(M2-1)
pushing a feeder ON button
(M2-2)
feeder clutch IN
(M2-3)
impression-on sensor S1 ON
(M2-4)
· intaglio ink rollers arrived
· duct rollers arrived
(M2-5)
impression-on sensor S2 ON
(M2-6)
impression cylinder arrived
(M2-7)
(c)
mode 3
a case of a sheet positioned at an impression-on sensor S1
restarting after an irregular sheet stopped
(M3-1)
pushing a feeder ON button
(M3-2)
· intaglio ink rollers arrived
· duct rollers arrived
· feeder clutch
(M3-3)
impression-on sensor S2 ON
(M3-4)
impression cylinder arrived
(M3-5)

stopping for sheet suppling

METHOD FOR CONTROLLING IMPRESSION-ON OPERATIONS FOR AN INTAGLIO PRINTING PRESS AND A DEVICE THEREOF

BACKGROUND OF THE INVENTION

The present invention relates to a method and a device for controlling impression-on operations for an intaglio printing press so as to print a sheet correctly from the first sheet after starting a printing operation.

FIG. 5 shows a conventional sheet-feed offset intaglio printing press for three-color printing. In the printing press, a sheet 1 is fed from a feeder 2 to an impression cylinder through a feeder board 3 and a paper feeding cylinder 4. On the other hand, each color ink is transferred on an outer periphery surface of a plate cylinder 8 through a duct roller 6*a*, 6*b*, 6*c* provided at a surrounding portion of the plate cylinder 8 and an intaglio ink roller 7*a*, 7*b*, 7*c*, respectively. The sheet 1 is printed by holding the sheet 1 between the plate cylinder 8 and the impression cylinder 5. A printed sheet 1 is discharged by a sheet discharging device 9 and piled at a pile portion 10.

In a sheet pass condition (in a printing operation), duct rollers 6*a*, 6*b*, 6*c*, the intaglio ink rollers 7*a*, 7*b*, 7*c* and the impression cylinder 5 are impressed on and these rollers (cylinders) are thrown off impression in a sheet stop condition (in a printing-off condition). An impression-on operation is operated after finishing a predetermined sensing process by a sensor 11 provided on the feeder board 3 after detecting an existence of the sheet 1. An irregular register, i.e. feeding over, bending, winding, double sheets feeding, corner folded sheet, a lack of a sheet and so on, of the sheet 1 at a down (up) stream of the feeder board 3 is detected by a irregular sheet sensor 12. A whole control is operated by a centralized control board 13.

In the sheet-feed offset intaglio printing press as shown in FIG. 5, after a printing operation is started, sheets from the first sheet to the second or third sheet can not be printed perfectly, so that such sheets are not utilized as a product. Such a problem is occurred every time after sheet supplying or sheet printing is reset after the sheet supplying stopped once. In the conventional printing press, there is a problem that an irregular ratio is relatively high.

It will be explained a reason why irregular printing is occurred with reference to an order of an impression-on operation. The first sheet 1 is fed to the feeder board 3 and then the impression-on sensor 11 detects an existence of the first sheet 1 at first. After the impression-on sensor 11 detecting the sheet 1, an operation for detecting a register condition is started by the irregular sheet sensor 12. When the first sheet 1 is approached to a front end of the feeder board 3, a condition of the sheet 1 is checked by the irregular sheet sensor 12 and then an impression-on operation is output from the centralized control board 13 after detecting the register set on a good condition. When an impression-on operation signal is output, the intaglio ink rollers 7*a*, 7*b*, 7*c* contact with the plate cylinder 8 at first and then the duct rollers 6*a*, 6*b*, 6*c* contacts with the intaglio ink rollers 7*a*, 7*b*, 7*c*, respectively and the impression cylinder 5 contacts with the plate cylinder 8 according to a degree of the sheet 1 feeding.

After the sheet 1 detected at a point A by the irregular sensor 12, it is necessary to feed the sheet 1 to a point B as a printing point by rotating a small diameter cylinder having a reference diameter, which is a diameter of paper feeding roll 4 and intaglio ink rollers 7*a*, 7*b*, 7*c*, 580° as angle of rotation. On the other hand, after detecting the register condition of the sheet by the irregular sheet sensor 12, the intaglio ink roller 7*a*, 7*b*, 7*c* and the duct roller 6*a*, 6*b*, 6*c* are moved in order responding to the impression-on operation by rotating these rollers 300° as angle of rotation. These rollers are rotated 1100° as angle of rotation by transmitting each color ink to the point B, in which each color ink is transferred from a peripheral surface of the duct rollers 6*a*, 6*b*, 6*c* to a peripheral surface of the intaglio ink rollers 7*a*, 7*b*, 7*c*, respectively. It needs 1400° angle of rotation at all. Therefor, the sheet 1 is arrived at the point B before the ink on the outer peripheral surface of the plate cylinder is arrived at the point B. In the printing press, the sheet 1 arrives at the point B before the plate cylinder on which a transferred ink is provided further rotates 820° (1400° − 580°) so as to transmit the ink at the point B. It means 2 revolutions of the small diameter cylinder and 100° as angle of rotation. The ink is not printed on the second sheet from the sheet supplying started. It begins to transfer the ink at an middle portion of the third sheet. The sheets from the fourth sheet can be utilized as a printing product and three sheets until the third sheet from the sheet suppling started are produced as an inferior product.

When the irregular sensor 12 detects an irregular register in a continuous printing operation of the printing press, the sheet supplying is stopped once. And then, an irregular sheet condition is adjusted and the sheet supplying is restarted so that the inferior products are produced again caused by the above described reason. The inferior products are piled on the pile portion 10 together with superior products. Therefor, a labour work is needed to pull out the inferior products from the piled sheet 1.

Upon considering the above prior art, the present invention provides a method and a device for controlling the impression-on operations of the intaglio printing press to print perfectly a sheet supplied from the first sheet.

SUMMARY OF THE INVENTION

To resolve the above problem, according to the present invention, when the first sheet from starting sheet supplying is positioned at an up stream of the feeder board, the ink rollers are impressed on. When the first sheet is arrived at a down stream of the feeder board, the impression cylinder is impressed on. If the irregular register is occurred in a print driving operation, the sheet supplying is stopped once and the ink rollers and the impression cylinder are thrown off impression.

In the present invention, a timing of the impression-on operation is hastened comparing with an impression-on timing in the conventional device so that it can be printed perfectly the first sheet from the sheet supplying started.

BRIEF DESCRIPTION OF THE DRAWINGS

FIG. 3 shows a flow chart of each operation mode for starting sheet supply;

DETAILED DESCRIPTION OF THE PREFERRED EMBODIMENT

Figure 1:
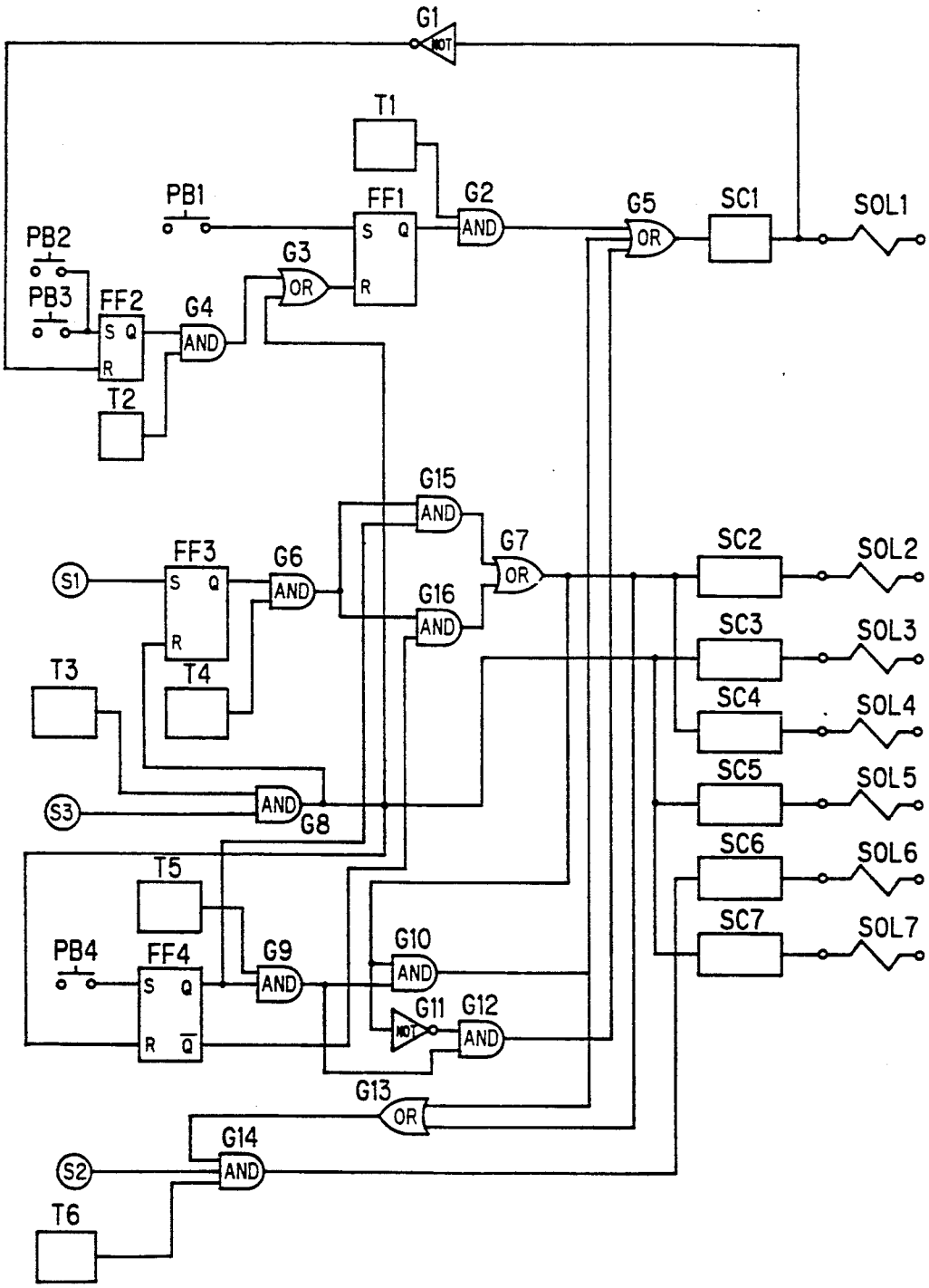
FIG. 1 is a circuit drawing showing an impression-on control device of a intaglio printing press of an embodiment according to the present invention.

FIG. 1 is a circuit drawing showing an impression-on control device of an embodiment of an intaglio printing press according to the present invention. The impression-on control device is formed of impression-on sensors S1, S2 in a type of a photoelectric sensor, a irregular sheet sensor S3, flip flop elements FF1–FF4, timming pulse generators T1–T6 for generating timming pulse synchronized with pulse from an rotary encoder in a body of the printing press, pushbuttons of a product start switch PB1, a product stop switch PB2, a feeder OFF switch PB3 and a feeder ON switch PB4, NOT gates G1, G11, AND gates G2, G4, G6, G8, G9, G10, G12, G14, G15, and G16, OR gates G3, G5, G7 and G13, solenoid driving devices SC1 through SC7 and solenoids SOL1 through SOL7.

Figure 2:
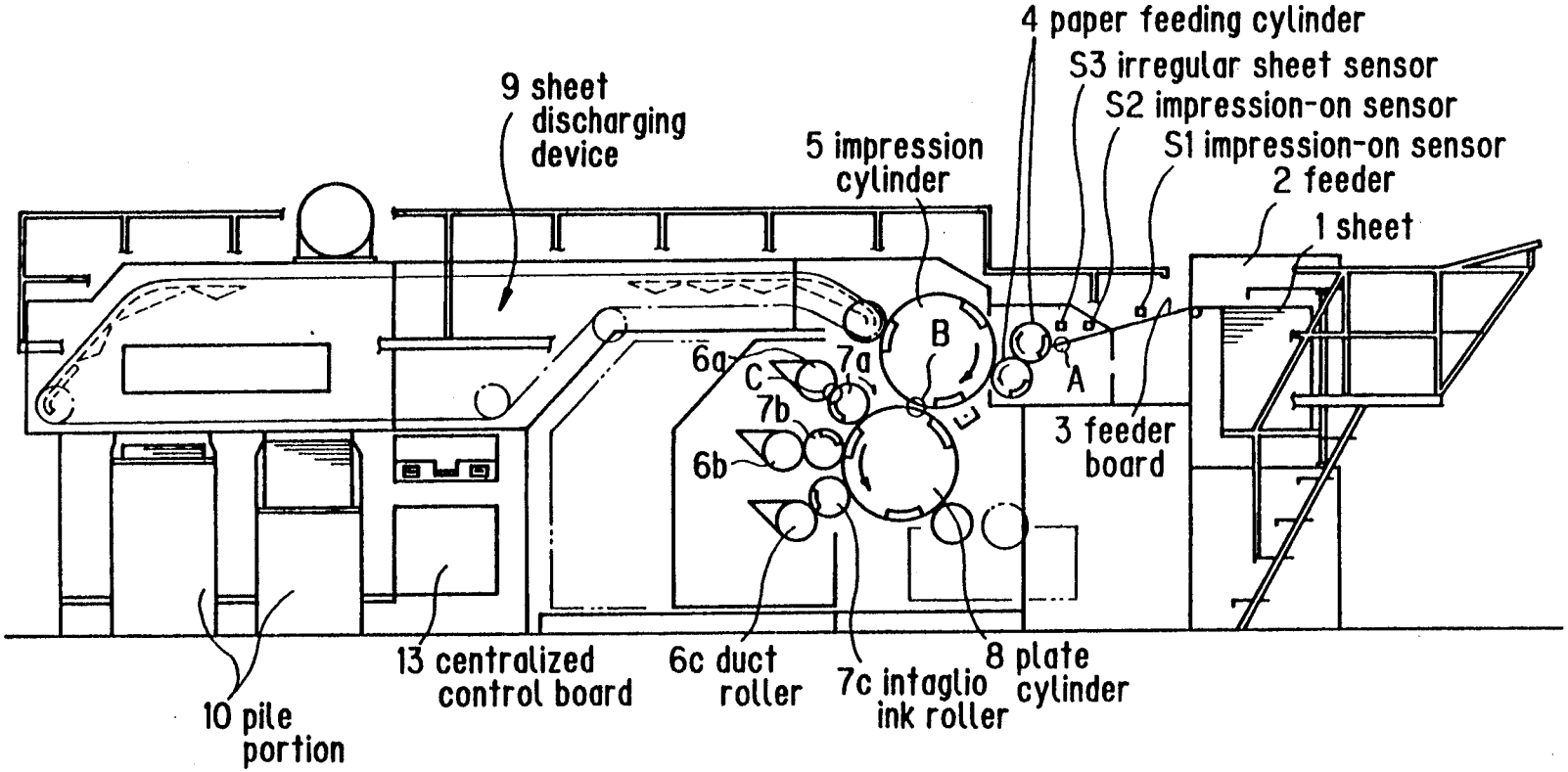
FIG. 2 shows the intaglio printing press utilizing the present invention.
Figure 5:
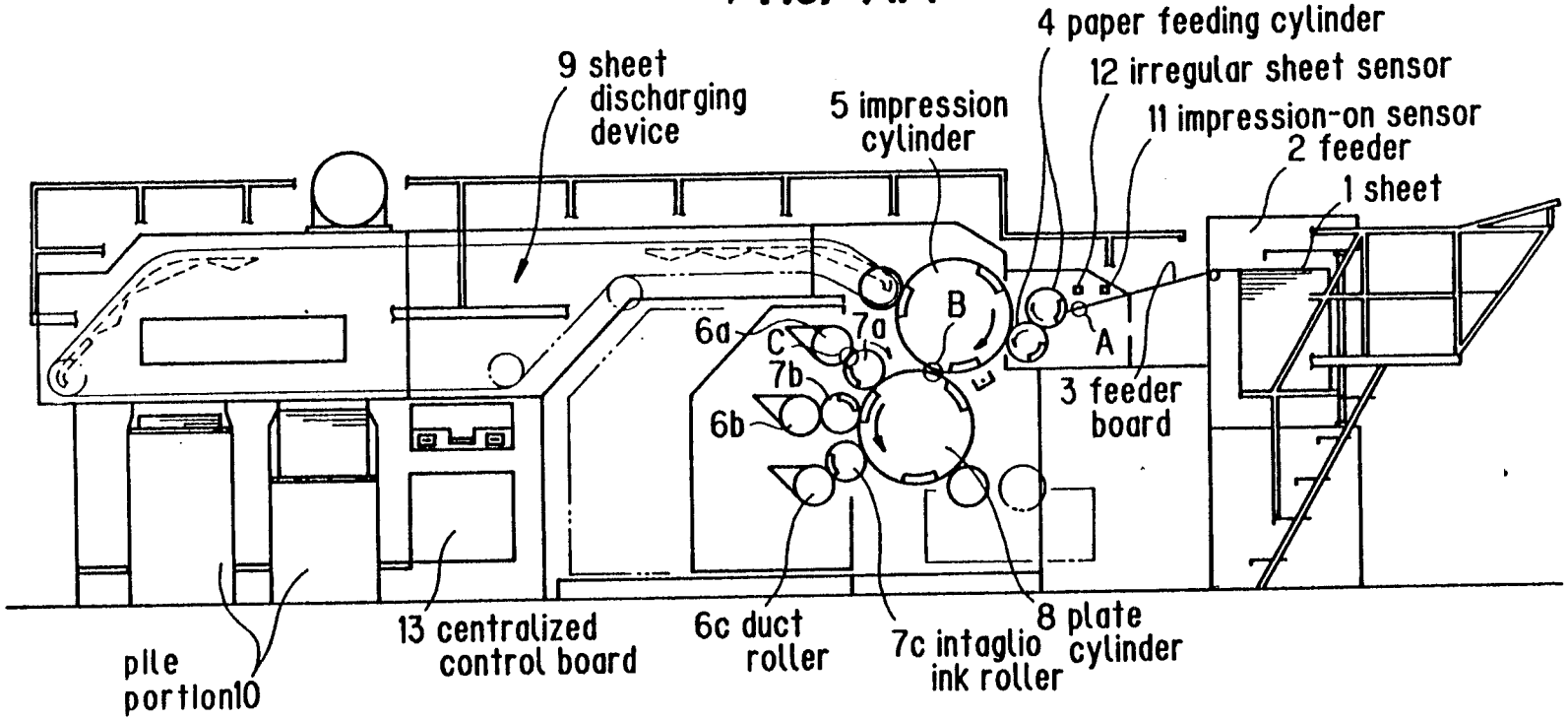
FIG. 5 Prior Art
FIG. 5 shows a conventional intaglio printing press.

The impression-on control device is provided at a sheet-feed offset intaglio printing press for three-color printing (which has the same structure as shown in FIG. 5) as shown in FIG. 2. The impression-on sensor S1, the impression-on sensor S2 and the irregular sheet sensor S3 are provided on the feeder board 3 in order with an interval from an upper stream to a down stream along a direction of feeding the sheet 1. Each impression sensor S1, S2 detects whether the sheet is located or not at a point of the sensor located. If the sheet is fed at the sensor located position, each sensor S1, S2 turns ON. The irregular sheet sensor S3 detects a register condition of the sheet arrived at the front end (down stream end) of the feeder board 3. If the register condition is inferior, the irregular sheet sensor S3 turns ON. Pushbuttons PB1 through PB4 are provided in the centralized control board 13. Each solenoid SOL1 through SOL7 is energized or deenergized by a respective solenoid driving device SC1 through SC7 for changing a pressurized oil supply line to a hydraulic cylinder so as to actuate a predetermined operation. To further explain, when the solenoid SOL1 is energized, a feeder clutch is operated and rotational driving force of the body of the printing press is transmitted to the feeder 2 and then the sheet 1 is fed out from the feeder 2. When the solenoid SOL1 is deenergized, the feeder clutch is released and the sheet supply from the feeder 2 is stopped. When the solenoid SOL3 is energized, intaglio ink rollers 7*a*, 7*b* and 7*c* are impressed on. When the solenoid SOL4 is energized, duct rollers 6*a*, 6*b* and 6*c* is impressed on the intaglio ink rollers 7*a*, 7*b*, 7*c*, respectively. When the solenoid SOL5 is energized, the duct rollers 6*a*, 6*b*, 6*c* are thrown off impression. When the solenoid SOL6 is energized, the impression cylinder 5 is impressed on the plate cylinder 8 and when the solenoid SOL7 is energized, the impression cylinder 5 is thrown off impression.

Figure 4:
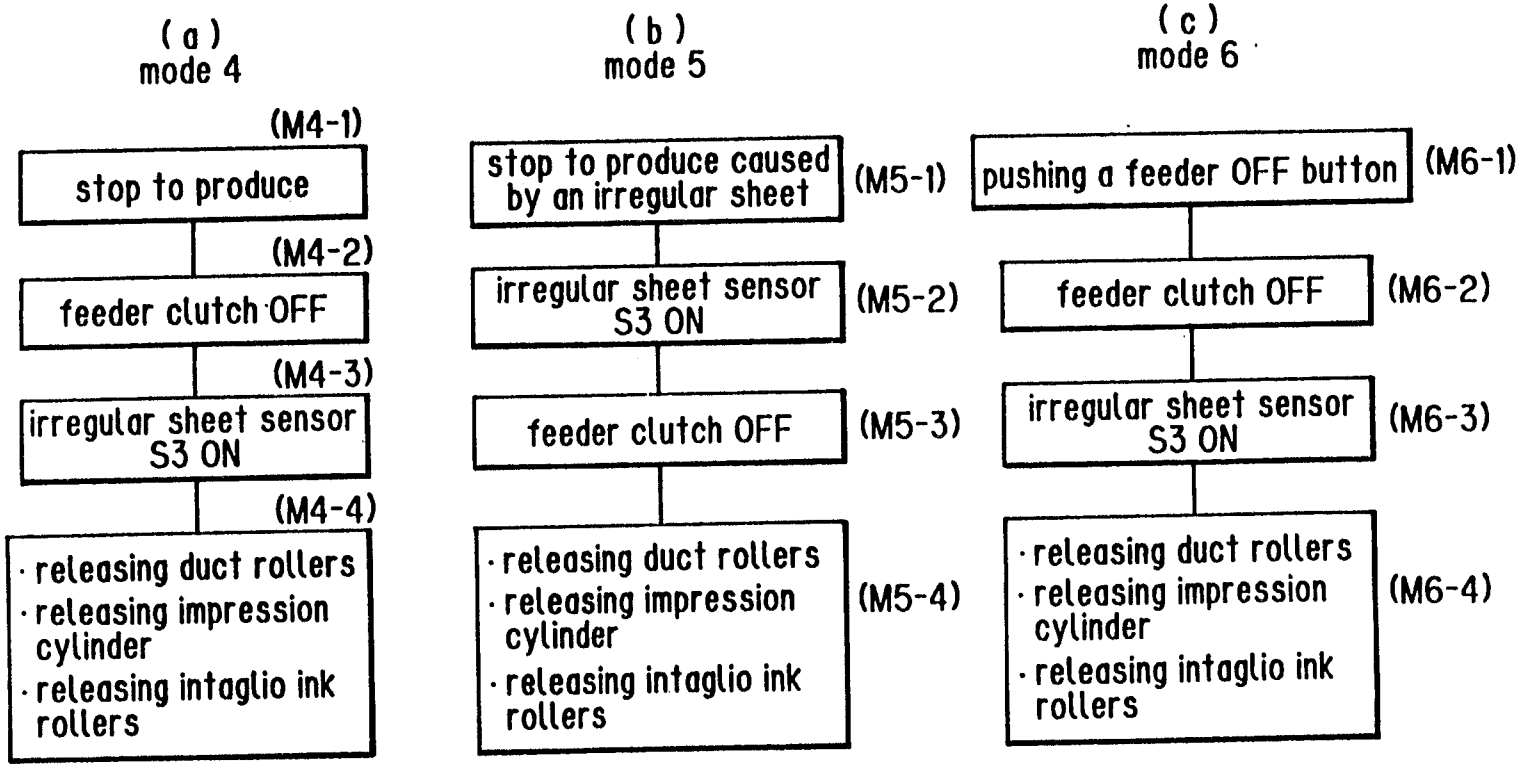
FIG. 4 shows a flow chart of each operation mode for stopping sheet supply.

In the impression-on control device of the embodiment, modes 1 through 3 is shown in FIG. 3(*a*), FIG. 3(*b*) and FIG. 3(*c*), respectively. Each mode 1 through 3 relates to an operation in a case of the sheet supplying started. Modes 4 through 6 is shown in FIG. 4(*a*), FIG. 4(*b*) and FIG. 4(*c*), respectively. Each mode relates to an operation ain a case of the sheet supplying stopped.

An operation at a time when the sheet supplying is started will be explained. In the embodiment, when the first sheet 1 from starting sheet supplying is arrived at the point B (in FIG. 2) as a holding portion positioned between the impression cylinder and the plate cylinder, impression-on timings of the intaglio ink rollers 7*a*, 7*b*, 7*c* and the duct rollers 6*a*, 6*b*, 6*c* and an impression throw-off timing of the impression cylinder 5 are controlled so as to transfer the ink on the first sheet 1 certainly depending on a feeding degree of the first sheet. That is, when the impression-on sensor S1 detects that the first sheet 1 is positioned at the up stream of the feeder board 3, the intaglio ink rollers 7*a*, 7*b*, 7*c* and the duct rollers 6*a*, 6*b*, 6*c* are impressed on. When the impression-on sensor S2 detects that the first sheet 1 is arrived at the down stream of the feeder board 3, the plate cylinder is impressed on. Thereby, the impression-on timing in the impression control device is hastened compared with an impression-on timing in the conventional device (as shown in FIG. 5). The timing of the ink arrived to the point B and the timing of the first sheet fed to the point B are coincided. In the conventional device, an impression-on operation is started after the irregular sheet sensor 12 (in FIG. 5) positioned at a down stream of the feeder board 3 detecting the sheet registered suitably. Upon comparing the present invention and the conventional device, the impression-on timing according to the conventional device is much delayed.

It will be explained an operation at a time when the sheet supplying is stopped. In the embodiment, the impression throw-off operation is started after an irregular resiter, for example, a lack of a sheet, detected by the irregular sheet sensor S3.

In the next, it will be explained each mode and a corresponding operation in the circuit portion as shown in FIG. 1 in each mode.

The mode 1 (in FIG. 3(*a*) is an operation mode (M1-1) at a time when it starts to produce. A level of an output terminal Q becomes a high level H by turning on a product start switch PB1 and inputing an one-shot input signal to a setting terminal S of the flip flop FF1. At that time, when the timing pulse is generated from the timing pulse generator T1, an output of the AND gate G2 becomes a high level H, and an output of the OR gate G5 also becomes a high level H. Therefor, the feeder clutch is operated (M1-2) by driving the solenoid driving device SC1 and energizing the solenoid SOL1. When the feeder clutch is operated, the sheet 1 is fed from the feeder 2, the impression-on sensor S1 turns ON (M1-3), the setting terminal S of the flip flop FF3 becomes a high level and the high level H of the output terminal Q is input to the AND gate G6. When the timing pulse is input from the timing pulse generator T4 to the AND gate G6 at that time, an output of the AND gate G6 becomes a high level H. Further, since the feeder ON switch PB4 is not turned ON, an output of the output terminal Q of the flip flop FF4 becomes a high level H and transmits to the AND gate G16 so that an output of the AND gate G16 becomes a high level H and an output of the OR gate G7 becomes a high level H. Therefor, the solenoids SOL2, SOL4 are energized by driving the solenoid driving device SC2, SC4 and the intaglio ink rollers 7*a*, 7*b*, 7*c* and the duct rollers 6*a*, 6*b*, 6*c* are impressed on (M1-4). And then, when the sheet 1 is arrived at the down stream of the feeder board 3, the impression-on sensor S2 is turned ON (M1-5). When the high level H signal input through the OR gate G13, the ON signal from the impression-on sensor S2 and the timing pulse signal from the timing pulse generator T6 are input to the AND gate 14, an output of the AND gate G14 becomes a high level H. Then, the solenoid driving device SC6 is driven, the solenoid SOL6 is energized and the impression cylinder is impressed on (M1-6).

The mode 2 (in FIG. 3(*b*)) is an operation mode for restarting (M2-1) at a time when the impression-on sensor S1 does not detect the sheet 1 after the irregular sheet sensor S3 detecting the irregular sheet and the sheet supplying is stopped. At first, the feeder ON switch PB4 turns ON (M2-2), the high level H signal is input to the setting terminal S of the flip flop FF4 and a level of the output terminal Q becomes a high level H. At that time, when the timing pulse is output from the timing pulse generator T5, an output of the AND gate G9 becomes a high level H and transmits to the AND gate G12. Another input signal of the AND gate G12 becomes a high level H at the time when the impression-on sensor S1 does not detect the sheet 1. Thereby, an output of the AND gate G12 becomes a high level H and an output of the OR gate G5 becomes a high level. Therefor, the feeder clutch is operated (M2-3) by driving the solenoid driving device SC1 and the solenoid SOL1, the sheet is fed from the feeder 2. Thus, the sheet 1 is fed and then the impression-on sensor S1 is turned ON (M2-4) and the intaglio ink rollers 7*a*, 7*b*, 7*c* and the duct rollers 6*a*, 6*b*, 6*c* are impressed on (M2-5). Further, the sheet 1 is fed and arrived at a down stream of the feeder board 3, the impression-on sensor turns ON (M2-6) and then the impression cylinder is impressed on.

The mode 3 (in FIG. 3(*c*) is an operation mode for restarting (M3-1) at the time when the impression-on sensor S1 detects the sheet 1 after the irregular sheet sensor S3 detecting the irregular sheet and the sheet supplying stopped. At first, the feeder ON switch PB4 turns ON (M3-2), and then the high level H signal is input to the setting terminal S of the flip flop FF4 and a level of the output terminal Q becomes a high level H and inputs to the AND gate G15. Another input signal of the AND gate G15 becomes a high level in case of the impression-on sensor S1 detecting the sheet 1. Therefor, an output of the AND gate G15 and the OR gate G7 becomes a high level H, the solenoid driving device SC2, SC4 and the solenoids SOL2, SOL4 are operated and the intaglio ink rollers 7*a*, 7*b*, 7*c* and the duct rollers 6*a*, 6*b*, 6*c* are impressed on (M3-3). An output of the AND gate G9 becomes a high level and inputs to the AND gate G10 by turning on the feeder ON switch PB4 and inputting an output of a timing pulse from the timing pulse generator T5.

The output of the AND gate G10 becomes a high level H and the output of the OR gate G5 becomes a high level H. Thereby, the feeder clutch is operated (M3-3) by driving the solenoid driving device SC1 and the solenoid SOL1 and then the sheet 1 is fed from the feeder 2. When the sheet 1 is arrived at the down stream of the feeder board 3, the impression-on sensor S2 is turned ON (M3-4) and the timing pulse is output from the timing pulse generator T6, so that the output of the AND gate G14 becomes a high level, the solenoid driving device SC6 and the solenoid SOL6 are driven and the impression cylinder is impressed on (M3-5).

The mode 4 is an operation mode at a time when it is stopped to produce. When the product stop switch PB2 is turned ON in a printing operation, an output terminal Q of the flip flop FF2 becomes a high level. In that time, when the timing pulse is output from the timing pulse generator T2, outputs of the AND gate G4 and the OR gate G3 become a high level H. Thereby, the output terminal Q of the flip flop FF1 becomes a low level L and the output of the AND gate G2 and the OR gate G5 becomes a low level L. Therefor, it is stopped to drive the solenoid driving device SC1, the solenoid SOL1 is deenergized and the feeder clutch is released (M4-2). By releasing the feeder clutch, the supply of sheets from the feeder 2 is stopped. When the last sheet 1 before stopping the sheet supplying is transmitted from the feeder board 3 to the paper feeding roller 4, the irregular sheet sensor S3 is turned on (M4-3). At that time, when the timing pulse is output from the timing pulse generator T3, the output of the AND gate G8 becomes a high level H, the intaglio ink rollers 7*a*, 7*b*, 7*c* and the duct rollers 6*a*, 6*b*, 6*c* and the impression cylinder 5 are thrown off impression (M4-4).

The mode 5 (in FIG. 4(*b*) is an operation mode for stopping the sheet supply (M5-1) by detecting the irregular sheet by the irregular sheet sensor S3. At that time, when a timing pulse is output from the timing pulse generator T3, an output of the AND gate G8 becomes a high level. Thereby, an output of the OR gate G3 becomes a high level, the flip flop FF1 is reset, the output of the AND gate G2 and the OR gate G5 becomes a low level and then the feeder culatch is released (M5-3). On the other hand, the solenoid coil driving devices SC3, SC5, SC7 and the solenoids SOL3, SOL5, SOL7 are actuated and the intaglio ink rollers 7*a*, 7*b*, 7*c* and the duct rollers 6*a*, 6*b*, 6*c* and the impression cylinder 5 are thrown off impression (M5-4).

The mode 5 (FIG. 4(*c*) is an operation mode at a time when the feeder OFF switch PB3 is pushed (M6-1). After pushing the feeder OFF switch PB3, those are operated an impression throw-off operation as same as the operation in the mode 4.

As described above with reference to the embodiment, according to the present invention, an impression-on operation of the impressed-on intaglio ink rollers and the duct rollers for transferring the ink is hastened comparing with an impression-on operation of the conventional device, so that it can be printed accurately on the first sheet from starting the sheet supply. In the conventional printing press, when the printing operation is restarted after stopping the printing press, several sheets from starting the sheet supply become inferior products, so that a labour work is needed to pull the inferior products from the pile portion 10 in the detecting operation. According to the present invention, an inferior product is not produced, the above described labour work is unnecessary and an operation efficiency is increased.

We claim:

1. A method of controlling impression-on and impression-off operations in an intaglio printing press, said intaglio printing press having an impression cylinder which is impressed on a plate cylinder, and having ink rollers which are impressed on said plate cylinder for transferring ink to said plate cylinder, and a sheet feeder mechanism for sequentially feeding sheets to be printed between said impression cylinder and said plate cylinder, said sheets being sequentially fed to said impression and plate cylinders from a feeder board from a position upstream of said feeder board to a position downstream of said feeder board;

said method being comprised by the steps of:

sensing the presence of a fed sheet at said upstream position on said feeder board by means of a first sensor;

initiating impression of said ink rolls on said plate cylinder in the presence of a said sheet sensed at said upstream position on said feeder board by said first sensor;

sensing the presence of a said sheet at said downstream position on said feeder board by means of a second sensor;

initiating impression of said impression cylinder on said plate cylinder in the presence of a said sheet sensed at said downstream position on said feeder board by said second sensor;

sensing the presence of a defective fed sheet by means of a third sensor positioned downstream of said second sensor, and, in the presence of a defective said sheet;

a) stopping the supply of said sheets by said sheet feeder;

b) simultaneously throwing said ink rollers out of ink transfer relation relative to said plate cylinder; and c) simultaneously throwing said impression cylinder out of impression relation relative to said plate cylinder, and removing said defective sheet and then re-establishing the supply of said sheets by said sheet feeder.

2. A device for controlling impression-on and impression-off operations of an intaglio printing press comprising an intaglio printing press having a plate cylinder, an impression cylinder mounted for movement for impression on said plate cylinder, ink rollers mounted for movement for impression on said plate cylinder for transferring ink to said plate cylinder, a feeder board, a sheet feeder mechanism for sequentially feeding sheets to be printed between said impression cylinder and said plate cylinder, said sheets being sequentially fed to said impression and plate cylinders from said feeder board to a position downstream of said feeder board, a control for said sheet feeder, impression-on and impression-off control means for said ink rolls and said impression cylinder, a first sensor located at said upstream position on said feeder board for detecting the presence on said feeder board of a said sheet;

a second sensor located at a downstream position on said feeder board and for detecting the presence on said board of a fed sheet;

a third sensor positioned downstream of said second sensor and for detecting the presence of a defective sheet exiting said board; and a control circuit operatively connected to said first, second and third sensors and operatively connected to said control for said sheet feeder and to said impression-on and impression-off control means for said ink rolls and said impression cylinder, said control circuit being operative to operate said control means for said ink rolls to an impression-on condition in the presence of a said sheet sensed by said first sensor;

said control circuit being operative to operate said control means for said impression cylinder to an impression-on condition in the presence of a said sheet sensed by said second sensor;

said control circuit being operative to operate said sheet feeder to an off-condition, and to operate said control means for said ink rolls and said impression cylinder to an impression-off condition in the presence of a defective sheet sensed by said third sensor.

* * * * *